US005599063A

United States Patent [19]

Lister et al.

[11] Patent Number: 5,599,063

[45] Date of Patent: Feb. 4, 1997

[54] BABY BATHING, FEEDING, SLEEPING AND SEATING CHAIR

[76] Inventors: Gary Lister; Deirdre Lister, both of 4400 N. Clybourn Ave., Burbank, Calif. 91505; Larry Morris; Sandra Morris, both of 2435 Cazaux Pl., Los Angeles, Calif. 90068

[21] Appl. No.: 403,431

[22] Filed: Mar. 14, 1995

[51] Int. Cl.[6] ..... B60N 2/02

[52] U.S. Cl. ..... 297/325; 4/572.1; 4/573.1; 297/467; 297/468; 297/464; 297/452.24; 297/452.33; 297/256.13; 297/256.11

[58] Field of Search ..... 4/572.1, 573.1; 297/467, 468, 464, 452.24, 452.33, 452.36, 256.13, 256.11, 325, 344.18

[56] References Cited

U.S. PATENT DOCUMENTS

| | | | |
|---|---|---|---|
| 2,509,040 | 5/1950 | Kibbe | 297/467 X |
| 3,037,813 | 6/1962 | Lowe | 297/467 |
| 3,176,700 | 4/1965 | Drury, Jr. | 135/45 |
| 3,325,213 | 6/1967 | Levy | 297/467 X |
| 3,545,016 | 12/1970 | Schorken | 4/572.1 X |
| 3,992,057 | 11/1976 | Studebaker | 297/467 |
| 3,995,331 | 12/1976 | Fotre et al. | 4/572.1 X |
| 4,248,478 | 2/1981 | Aron | 297/174 |
| 4,362,333 | 12/1982 | Cohen | 297/174 |
| 4,510,634 | 4/1985 | Diedrich et al. | 297/464 X |
| 4,707,024 | 11/1987 | Schrader | 297/464 X |
| 4,772,068 | 9/1988 | Gleckler et al. | 297/325 X |
| 4,815,732 | 3/1989 | Mahvi | 297/467 X |
| 5,092,001 | 3/1992 | Ross et al. | 4/572.1 X |
| 5,115,523 | 5/1992 | Cone | 297/464 X |
| 5,161,522 | 11/1992 | Clevenger | 297/467 X |
| 5,181,284 | 1/1993 | Raphael et al. | 4/572.1 X |
| 5,276,926 | 1/1994 | Lopez | 4/572.1 X |
| 5,297,300 | 3/1994 | Sheu . | |
| 5,321,859 | 6/1994 | Buckshaw et al. | 297/467 X |
| 5,361,430 | 11/1994 | Wise | 4/573.1 X |
| 5,372,405 | 12/1994 | Cash et al. | 297/467 X |
| 5,425,149 | 6/1995 | Crossley et al. | 4/572.1 X |

FOREIGN PATENT DOCUMENTS

| | | | |
|---|---|---|---|
| 0609890 | 8/1994 | Germany | 297/256.13 X |

OTHER PUBLICATIONS

Daphné Bain Liberté label.

*Primary Examiner*—Peter M. Cuomo
*Assistant Examiner*—Stephen Vu
*Attorney, Agent, or Firm*—Christie, Parker & Hale, LLP

[57] ABSTRACT

A seat-like apparatus having a cradling surface capable of supporting and cradling an infant at an angle of 30°, an angle greater than 30°, and an angle less than 30° for facilitating feeding, washing, seating, and sleeping. The angle of support is adjusted using rear adjustable legs. By adjusting a crotch support on the cradling surface, infants of different heights can be accommodated. In addition, adjustable length straps are provided for securing the infant on the cradling surface, as well as suction cups attached to the feet of the seat-like apparatus for non-permanently securing the apparatus to objects such as a bathtub or tabletop.

8 Claims, 6 Drawing Sheets

Fig. 5a
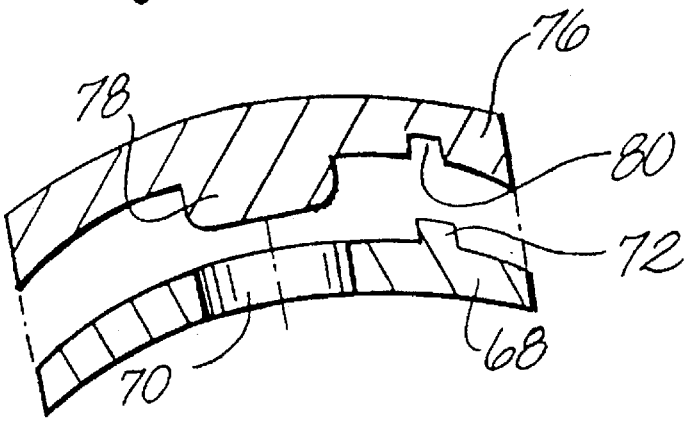
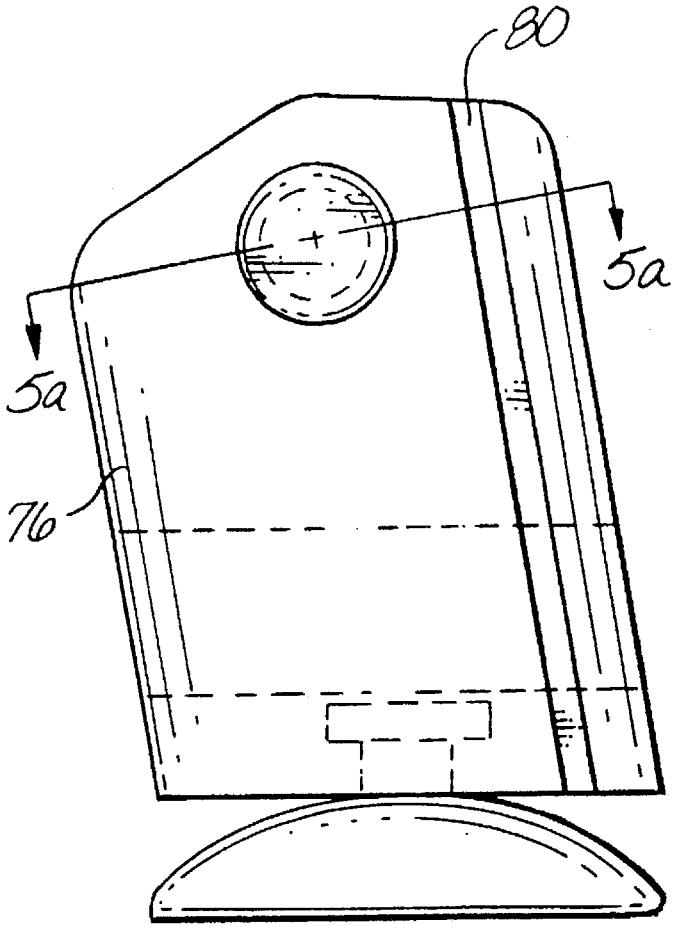
Fig. 5b

BABY BATHING, FEEDING, SLEEPING AND SEATING CHAIR

FIELD OF THE INVENTION

The present invention relates to a cradling surface for supporting an infant at a user selected inclined angle for the purposes of bathing, feeding, sleeping and seating.

BACKGROUND OF THE INVENTION

There are intricacies that are involved in bathing and feeding an infant. Bathing an infant in a bath tub or a baby tub is a difficult and sometimes dangerous proposition. The infant must be supported at all times to prevent slipping that can lead to injury. This means that the person bathing the infant must support the wet slippery infant with one hand while bathing it with the other.

Typically after they are fed, infants often spit up. This is caused by air bubbles swallowed with the food. To prevent spitting up it is recommended that an infant be propped up to a 30° angle for 20 minutes after being fed. This allows gravity to push the food down while at the same time allowing any air bubbles to rise facilitating burping. When sleeping, infants are more comfortable at an angle lower than 30°. On the other hand, when sitting, an infant may want to be inclined at an angle greater than 30° so he or she can view his or her surroundings. A cradling surface, therefore, which can cradle and support an infant in a bath tub or baby tub to facilitate bathing, that is capable of supporting an infant at an angle of 30° to facilitate burping without spitting up, after feeding, which can keep the baby at an angle less than 30° to facilitate sleeping and at an angle greater than 30° to facilitate seating would be of great assistance to a person taking care of an infant. Such a cradling surface must be capable of adjusting itself to different incline angles, must be capable of being secured to a bathtub, a tabletop or other surface. Furthermore, such a cradling surface must be capable of accommodating infants of different heights. The surface must be made of a material that is comfortable to the baby. In addition, it must provide means for securing the baby and means for preventing the baby from slipping down its length.

While Sheu, U.S. Pat. No. 5,297,300 discloses an inclining surface, such surface is limited for use in a bathtub only and cannot support itself outside of the bathtub. Furthermore, the Sheu patent does not discloses a cradling surface for supporting an infant for feeding, washing, seating and sleeping, where such a surface is self-supporting, and where such a surface can be easily secured in a bathtub as well as on a tabletop or other surface. In addition, another prior art disclosed surface for supporting infants, cannot be inclined to the appropriate angles to facilitate better infant feeding, bathing, seating and sleeping.

SUMMARY OF THE INVENTION

The present invention provides for a cradling surface which supports and cradles an infant. The cradling surface can be inclined to angles greater than 30° and less than 30° to facilitate feeding, washing, seating, and sleeping. A bell-shaped piece, for supporting the infant crotch, translates along the cradling surface length to accommodate infants of different heights. The cradling surface has legs on which there are connected suction cups. These suction cups provide the means for securing the cradling surface in position on a bathtub or on other flat surfaces, such as a tabletop, to facilitate the aforementioned tasks. The cradling surface is injection molded from plastic with edges and contours that are rounded and smooth to prevent scratching or scraping of the infant's skin.

BRIEF DESCRIPTION OF THE DRAWINGS

FIG. 5*a* is a cross-sectional view of the rear leg/channel piece interface of the rear leg length adjusting structure.

FIG. 5*b* is a side view of the channel piece of the rear leg length adjusting structure.

DETAILED DESCRIPTION

Figure 1:
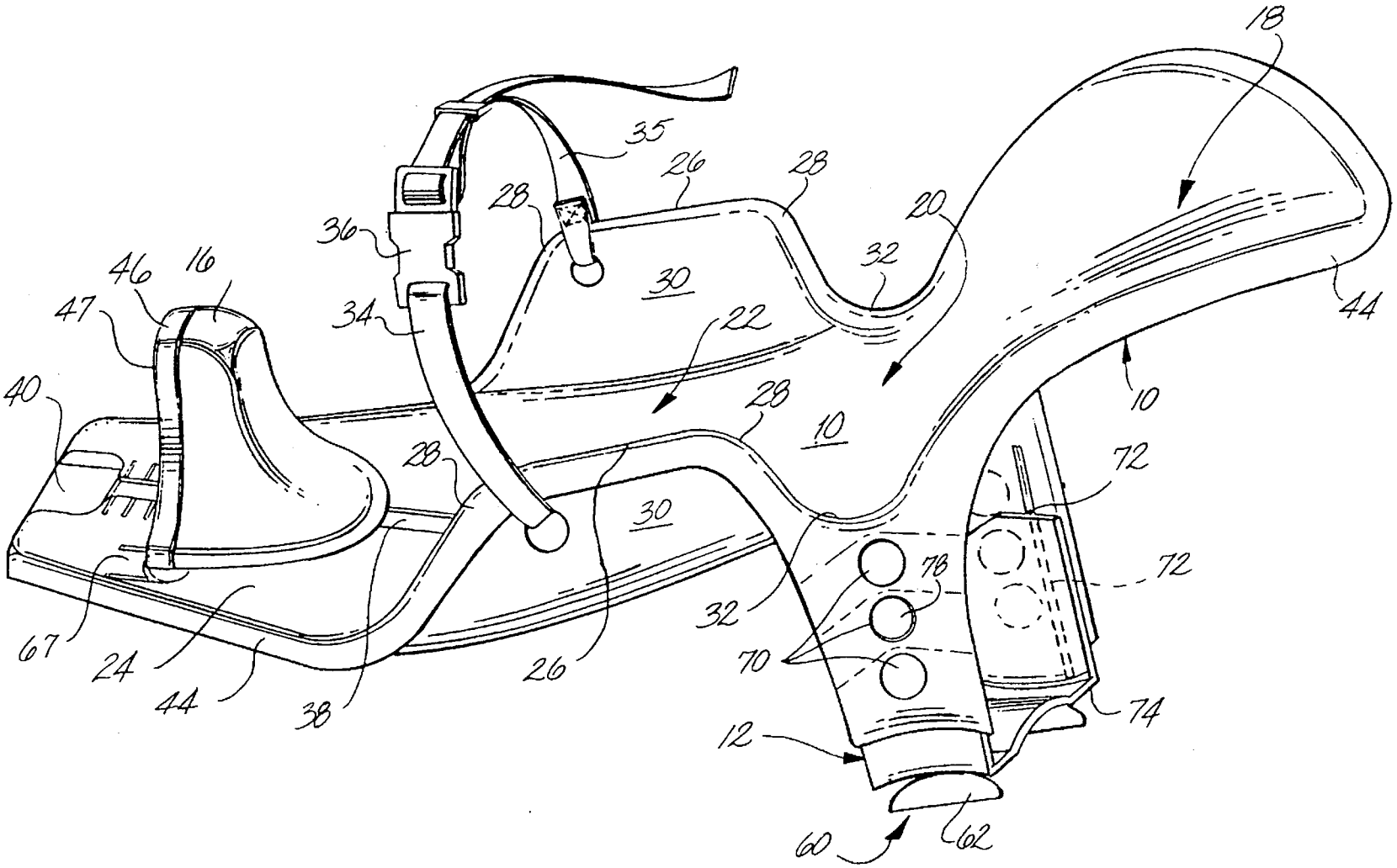
FIG. 1 is an isometric view of the seat-like apparatus.
Figure 2:
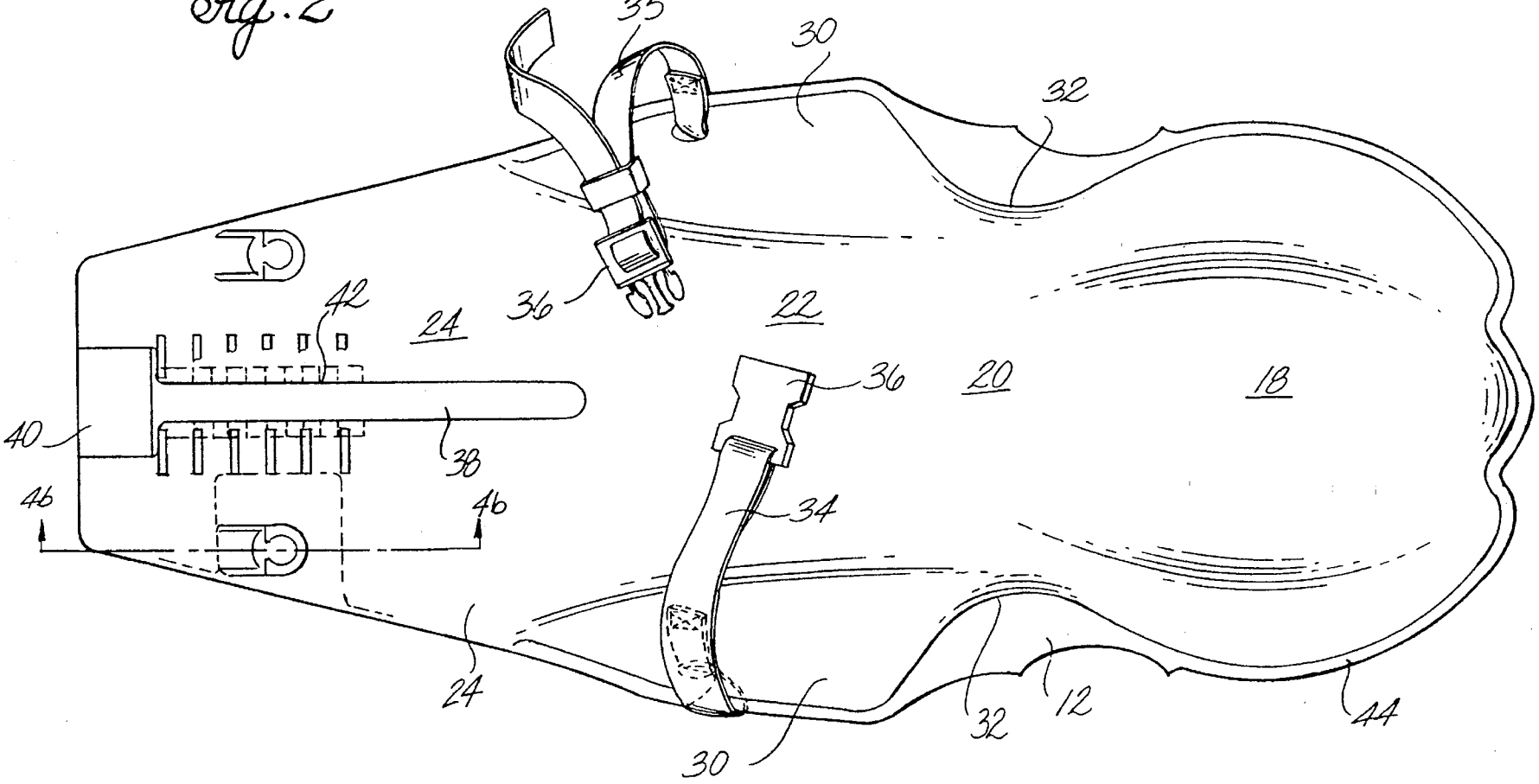
FIG. 2 is a top view of the seat-like apparatus.
Figure 3:
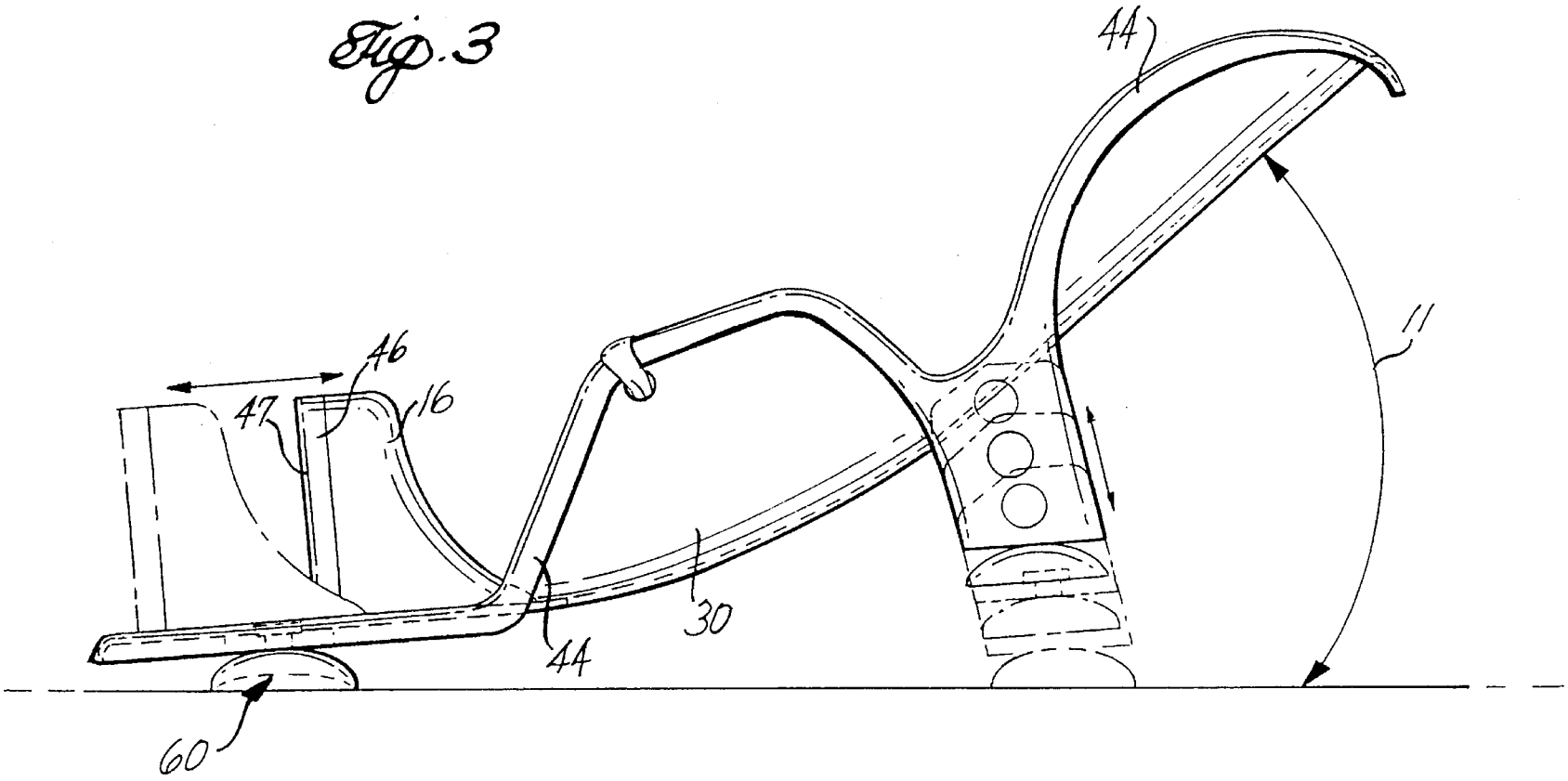
FIG. 3 is a side view of the seat-like apparatus.

Referring to the figures, a seat-like apparatus 10 for supporting and inclining an infant to various angles 11 for facilitating feeding, bathing, sleeping and seating (FIGS. 1, 2, and 3). The apparatus comprises of an injection molded cradling surface 10 having four legs, two adjustable rear legs 12 and two front legs 14, and an injection molded adjustable crotch support 16. The cradling surface can range from approximately 15 to 25 inches. For descriptive purposes, the apparatus is divided into four sections:

(1) The upper section 18;

(2) The middle-upper section 20;

(3) The middle section 22; and (4) The lower section 24.

The cradling surface gradually inclines from a horizontal position to an angle 11 of approximately 30°. The lower section 24 remains in a relatively horizontal position. The middle section 22 gradually inclines approximately 30° from a horizontal position at its end adjacent to the lower section. The upper-middle section and the upper sections remain inclined at approximately a constant angle.

The upper section 18 which spans approximately a quarter of the cradling surface length and which is relatively circular shaped flows into a neck-shaped upper-middle section. The upper-middle section 22 is narrower than the upper section and spans approximately 1/20th of the cradling surface length. The upper and upper-middle sections are gradually curved upwards about a central longitudinal axis. This curvature provides cradling support to the infant's head.

The middle section spans approximately 1/3 of the cradling surface length and has a width greater than that of the upper-middle and upper sections. The middle section has squared edges 26 with rounded corners 28 forming fin shaped surfaces 30. These fin-shaped surfaces are bend upwards approximately 70° from the horizontal giving the middle section a "deep dish" cross-section. The middle section cradles and supports the infant's torso below the armpits.

The upper-middle section edges, along with the lower edges of the upper section and the upper portion of the edges of the fin-shaped sections, form continuous "U" shaped edges 32 to allow the infant to extend his/her arms outside the cradling surface and also to support the upper arms.

The ends of straps 34 and 35 are connected proximate the edge of each fin-shaped surface 30. The other ends of the strap connect to each other via a quick-connect, quick-release type of mechanism 36. The strap lengths can be adjusted at the mechanism ends. Once the infant is in position on the cradling surface, the straps are used to secure the infant in position.

The lower section 24, spanning approximately ⅓ of the cradling surface, is trapezoidal in shape widening towards the middle section. The lower section has a slot 38 at its center. The slot begins at a location proximate to the lowest end of the section and spans the remaining length of the section. The end surface 40 of the lower section, proximate the down-end of the slot, is depressed. The undersurface of the slot edges has multiple indentations 42 (FIG. 4*a*).

The edges of the cradling surface are bend to form a lip 44 which spans the perimeter of the cradling surface with the exception of the lowest section depressed end surface 40. Furthermore, the lip formed on the lower section is tapered in a direction away from the middle section. This taper allows the cradling surface to be inclined without the lowest end lip making contact with the surface on which it rests. At the upper-middle section, at each edge, the vertical portion of the lip extends approximately 2¼ inches to form the rear two legs. The lip section is continuous over the perimeter of the cradling surface beginning and ending at the depression at the lower end of the lower section.

Figures 4A, 4B:
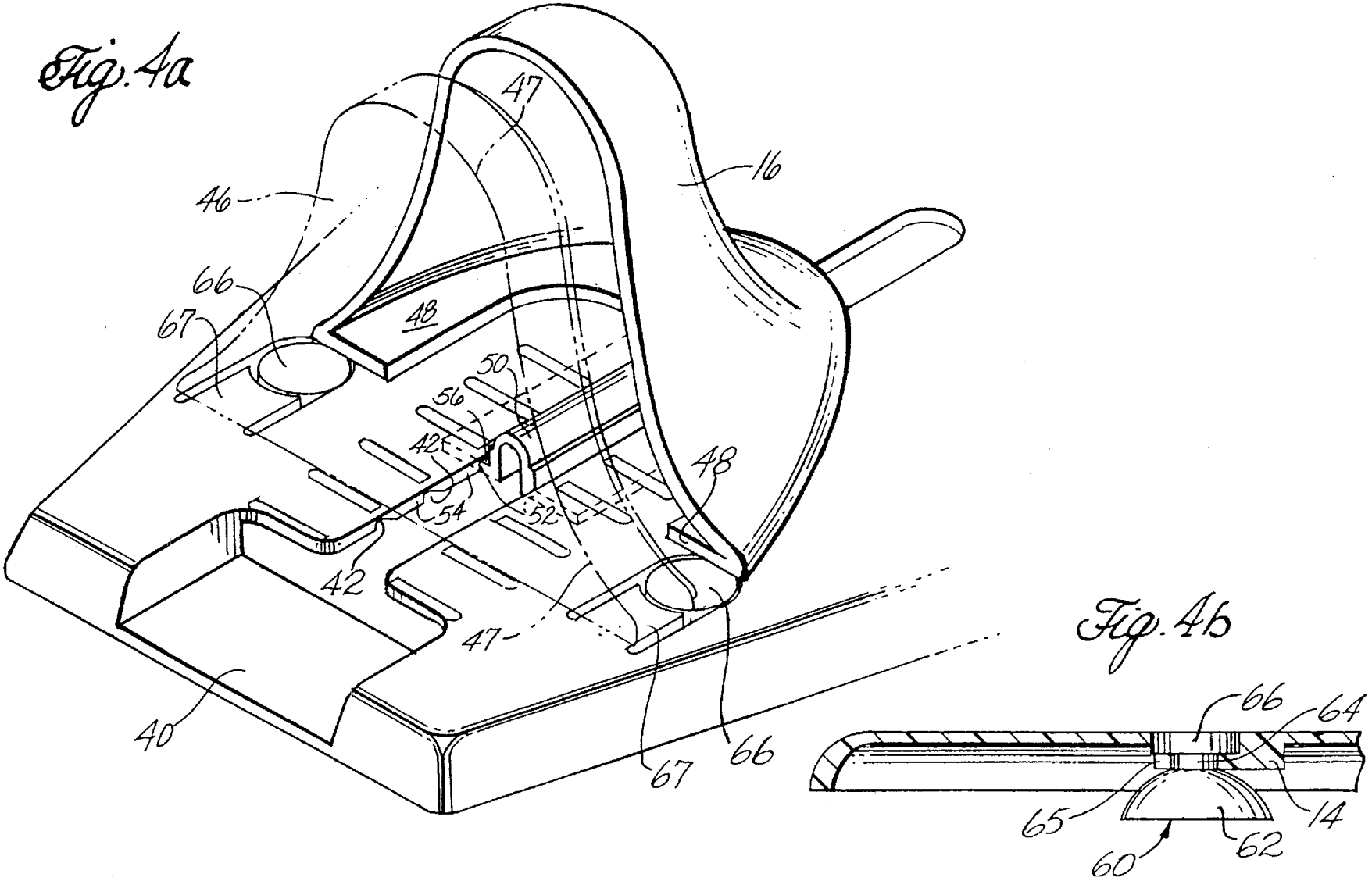
FIG. 4*a* is an isometric view of the lower section of the seat-like apparatus including details of the adjustable crotch supporting piece.
FIG. 4*b* is a cross-sectional view of the front legs.

A half-bell shaped piece 16 with a cover 18 is adjustably mounted, facing the upper section of the cradling surface, on the lower section slot edges (FIG. 4*a*). This piece which is shaped to conform to the infant's crotch provides adjustable crotch support. "Half-bell shaped" as used herein refers to the shape of a bell having an outwardly flaring opening, which is bisected by a plain encompassing the bell's longitudinal (vertical) axis. The cover 46 provides smooth edges 47 to prevent scrapes to the infant's legs that may occur due to rubbing of the infant's legs against the edges of the half-bell shaped piece. The edges 48 of the bottom opening of the half bell shaped piece are bent inward, towards the bell vertical central axis, to a substantially horizontal position. To allow the bell-shaped piece to be moved along the slot, so that the crotch support can be adjusted for infants of different heights, a bar-shaped piece 50 extends from the horizontally bent edges 48. The horizontally bent edges intersect the bar-shaped piece 50 proximate its upper end. The bar-shaped piece has a width which is slightly smaller than the slot opening width so that the bar shaped piece can slide in the slot along the slot length. A surface 52 (denoted as "bar-bottom" surface herein) extends on either side of the bar piece level with the bar piece bottom face. The bar-bottom surface is parallel to the horizontal bell edges 48. The bar-bottom surface 52 and the horizontally bent edges 48 sandwich the slot edges 54, allowing the bar shaped-piece to slide along the Slot. A tooth 56 on either side of the bar piece protrudes from the upper portion of bar-bottom surface. These teeth are positioned to engage the indentations 42 on the undersurface of each slot edge to lock the bar piece and half-bell-shaped piece in position. The half bell shaped surface, therefore, is able to freely slide along the slot and may lock at a location by engaging the bar bottom surface teeth 56 to the indentations. In essence, the teeth and the indentations form a rachet type of mechanism.

Two front legs 14 are located approximately at 40% of the length of the lower section measured from the lowest end (FIG. 4*a*). The legs are located proximate each edge of the lower section. The height of these legs is approximately ½ inch. Each of the front legs is shaped to accommodate a suction cup 60 which is used to secure the cradling surface in place. The suction cups are inverted "goblet" shaped. They comprise of a bowl shaped piece 62, a stem 64, and a foot 66 (FIG. 4*b*). The whole suction cup structure is molded from rubber. To accommodate the suction cups, the front legs are hollow. The bottom surface of the legs are "C" shaped. The length of the stems 64 is matched to the thickness of the bottom surface 65 of each leg. Furthermore, the diameter of the stem is matched to the opening formed by the "C" shaped leg surface. The suction cup stem snaps into place in the "C" opening. The foot of each suction cup holds the suction cup in place preventing it from sliding out from the leg. A moveable tab 67 originating at the cradling surface proximate each leg in front of the "C" opening secures each suction cup in place. Each tab is aligned to the height of the suction cup foot, thereby, preventing the suction cup from "snapping" out of the "C" shaped foot. To install the suction cups, the tabs are moved to allow access to the "C" opening and the suction cup stems are snapped in the "C" opening.

Figure 6:
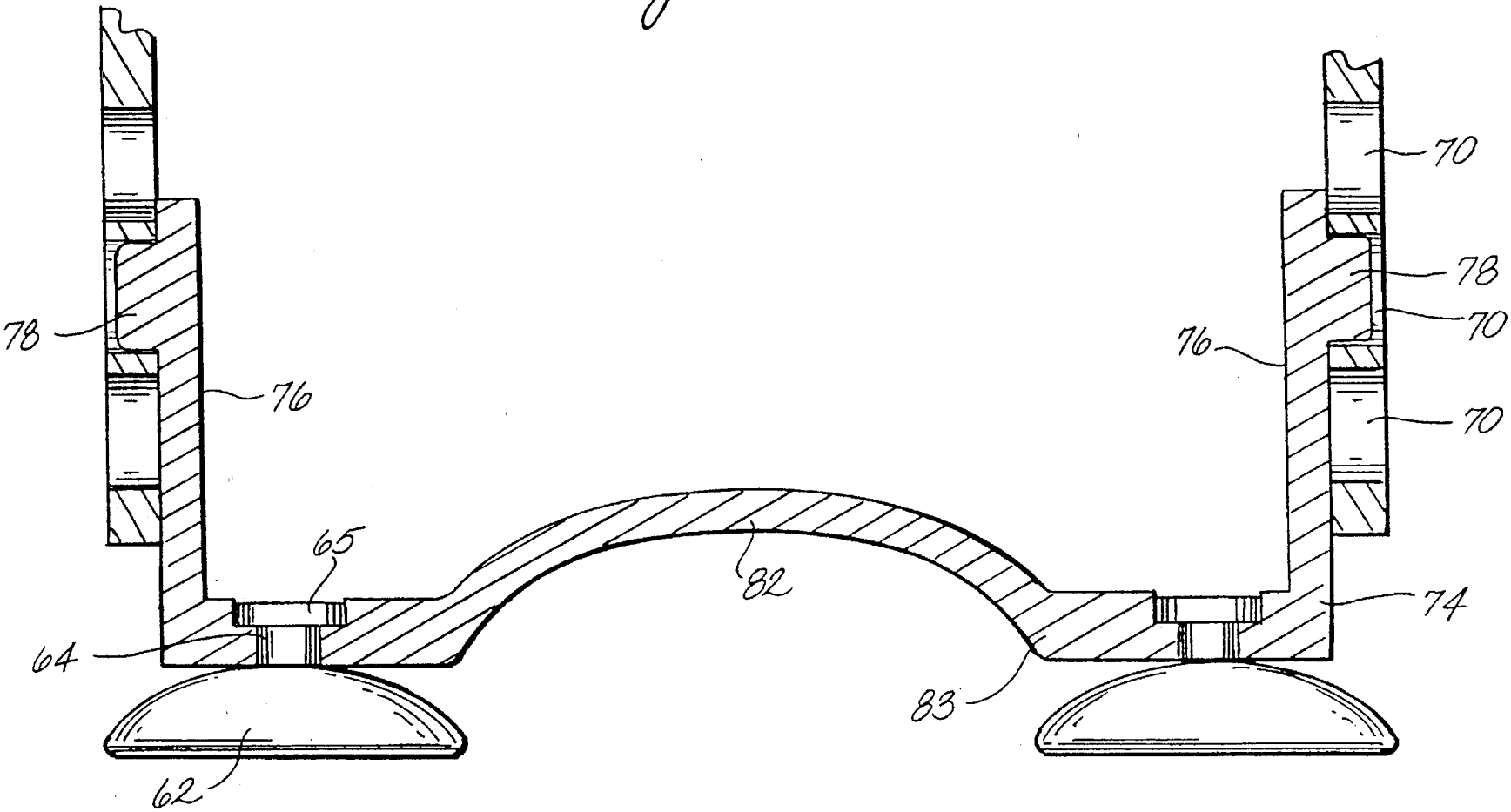
FIG. 6 is a cross-sectional view of the rear leg length adjusting structure, including the rear legs and channel piece, which serves to incline the seat-like apparatus to a plurality of angles.

The two rear legs 12, which extend from the upper-middle section, and which are part of the lip, are curved forming a shallow half moon curvature 68 in the direction away from the cradling surface (FIG. 5*a*). Each rear leg has three circular openings 70 (FIG. 6) along its central longitudinal axis. There is an approximate ¾ inch vertical distance between each opening. The location of the openings is the same for both rear legs. A bar-shaped protrusion 72 extends on the inner surface of each of the rear legs 12. The bar-shaped protrusion 72 spans the. length of each leg and is adjacent and parallel to an imaginary line formed by the openings. A channel-shaped piece 74 ("channel") fits tightly between the inner surfaces of the rear legs (FIG. 6). When inserted between the two rear legs, the channel faces upwards. The vertical members 76 of the channel are contoured to match the inner contour of the legs. A button-like protrusion 78 matched to the openings 70 on the rear legs is located on the outer surface of each vertical member 76 of the channel to engage the openings on each leg, A groove 80 on the outer surface of each vertical member 76 of the channel piece, matching the bar-shaped protrusion 72, is aligned to engage the bar-shaped protrusion 72 on each rear leg. These grooves guide the bar-shaped protrusions and channel piece up and down the rear legs so that the button-like protrusions engage the openings on the rear legs to lock the channel in place.

The central portion 82 of the horizontal member 83 of the channel is curved upward. This curvature spans approximately half the length of the horizontal member. This curvature allows for flexure of the horizontal member which in turn allows for the channel piece to be compressed in a direction parallel to the horizontal member. As the channel is moved up or down the rear legs along the bar shaped protrusion, the channel is compressed in the horizontal direction. When the button-like protrusions 78 engage the openings on either rear leg 12, the compressing force is released and the channel piece expands forcing the tight engagement between the button-like protrusion 78 and the openings 70 locking the channel in place. To disengage the channel, the button-like protrusions are pushed out of the openings in the rear legs while the channel is slid up or down. In essence, the channel can be moved up and down to engage any of the three openings on the rear legs providing a means for adjusting the length of the rear legs which in turn adjusts the incline angle of the cradling surface.

A suction cup 60 is connected to the horizontal portion of the horizontal member 83 of the channel piece on each side of the curvature (FIG. 6). These suction cups also serve to secure the cradling surface in place. The suction cups are identical to those used with the front legs. They interface with the channel piece in the same way as they interface with the front legs.

When the channel piece engages the middle level openings of the rear legs, the maximum incline of the cradling surface is at approximately 30°.

Having now described the invention as required by the patent statutes those skilled in the art will recognize modifications and substitutions to the elements of the embodiments disclosed herein. Such modifications and substitutions are within the scope of the present invention as defined in the following claims.

What is claimed is:

1. An apparatus for supporting an infant to facilitate feeding, bathing or sleeping, comprising an oblong cradling surface comprising a lower section, a middle section, an upper-middle section and an upper section, wherein the cradling surface is inclined, the apparatus comprising:

a surface for cradling an infant's body formed by the middle and upper-middle sections of the cradling surface, wherein the upper-middle section is narrower than the upper section, wherein the upper-middle section edges are concave, wherein a width of the middle section is greater than a width of the upper section, wherein a portions of the middle section extending beyond a width of the upper-middle section have square shapes with rounded corners, and wherein the extending portions are bent upwards;

means for cradling an infant's head extending from an upper portion of the means for cradling an infant's body;

means for accommodating an infant's arms located between the means for cradling an infant's head and the means for cradling an infant's body;

means for supporting the infant's legs extending from a lower portion of the means for cradling an infant's body, forming the lower section of the cradling surface;

means for securing an infant on the cradling surface;

means for supporting an infant's crotch separate from the infant securing means, the means for supporting the infant's crotch extending perpendicularly from the lower section of the cradling surface;

means for adjusting the crotch supporting means to accommodate infants of various heights;

means for inclining the cradling surface to a plurality of angles;

means for securing the apparatus to a surface; and means for supporting the cradling surface.

2. An apparatus for supporting an infant to facilitate feeding, bathing or sleeping, comprising an oblong cradling surface comprising a lower section, a middle section, an upper-middle section and an upper section, wherein the cradling surface is inclined, the apparatus comprising:

means for cradling an infant's body;

means for cradling an infant's head extending from an upper portion of the means for cradling an infant's body;

means for accommodating an infant's arms located between the means for cradling an infant's head and the means for cradling an infant's body;

means for supporting an infant's legs extending from a lower portion of the means for cradling an infant's body, forming the lower section of the cradling surface;

means for securing an infant on the cradling surface;

a crotch support comprising, at least a half-bell shaped shell surface attached upright to the lower section, approximately central, of the cradling surface, facing the upper section of the cradling surface, and a cover with rounded corners fitted against a edges of the shell surface separate from the infant securing means, the crotch support extending perpendicularly from the lower section of the cradling surface;

means for adjusting the crotch support to accommodate infants of various heights;

means for inclining the whole cradling surface to a plurality of angles;

means for securing the apparatus to a surface; and means for supporting the cradling surface.

3. An apparatus for supporting an infant to facilitate feeding, bathing or sleeping, comprising an oblong cradling surface comprising a lower section, a middle section, an upper-middle section and an upper section, wherein the cradling surface is inclined, the apparatus comprising:

means for cradling an infant's body;

means for cradling an infant's head extending from an upper portion of the means for cradling an infant's body;

means for accommodating infant's arms located between the means for cradling an infant's head and the means for cradling an infant's body;

means for supporting an infant's legs extending from a lower portion of the means for cradling an infant's body, forming the lower section of the cradling surface;

means for securing an infant on the cradling surface;

means for supporting an infant's crotch separate from the infant securing means, the means for supporting an infant's crotch extending perpendicularly from the lower section of the cradling surface;

a slot spanning a length of the lower section of the cradling surface;

a plurality of indentations on a bottom surface of the lower section of the cradling surface proximate to edges of the slot;

a surface piece, connected to the crotch supporting means engaging the bottom surface of the slot edges comprising two teeth wherein each tooth locks against the indentations forming a rachet type mechanism, wherein the surface piece connected to the crotch supporting means can slide along the slot and lock at any indentation for adjusting the crotch supporting means;

means for inclining the cradling surface to a plurality of angles;

means for securing the apparatus to a surface; and means for supporting the cradling surface.

4. An apparatus for supporting an infant to facilitate feeding, bathing or sleeping, comprising an oblong cradling surface comprising a lower section, a middle section, an upper-middle section and an upper section, wherein the cradling surface is inclined, the apparatus comprising:

means for cradling an infant's body;

means for cradling an infant's head extending from an upper portion of the means for cradling an infant's body;

means for accommodating the infant's arms located between the means for cradling an infant's head and the means for cradling an infant's body;

means for supporting infant's legs extending from a lower portion of the means for cradling an infant's body, forming the lower section of the cradling surface;

means for securing an infant on the cradling surface;

means for supporting an infant's crotch separate from the infant securing means, the means for supporting an infant's crotch extending perpendicularly from the lower section of the cradling surface;

means for adjusting the crotch supporting means to accommodate infants of various heights;

adjustable rear legs, wherein the rear legs are extensions of the upper-middle section edges which are bent downwards forming the legs;

means for securing the apparatus to a surface; and means for supporting the cradling surface.

5. An apparatus for supporting an infant to facilitate feeding, bathing or sleeping, comprising an oblong cradling surface comprising a lower section, a middle section, an upper-middle section and an upper section, wherein the cradling surface is inclined, the apparatus comprising:

means for cradling an infant's body;

means for cradling an infant's head extending from an upper portion of the means for cradling an infant's body;

means for accommodating infant's arms located between the means for cradling an infant's head and the means for cradling an infant's body;

means for supporting infant's legs extending from a lower portion of the means for cradling an infant's body, forming the lower section of the cradling surface;

means for securing an infant on the cradling surface;

means for supporting an infant's crotch separate from the infant securing means, the means for supporting an infant's crotch extending perpendicularly from the lower section of the cradling surface;

means for adjusting the crotch supporting means to accommodate infants of various heights;

two adjustable rear legs;

a channel-shaped structure comprising a horizontal member and two vertical members, wherein an outer surface of the vertical members mate against an inner surface of the rear legs, wherein each of said rear legs comprises a plurality of openings in a line parallel to a longitudinal axis of each of said rear legs and a bar-shaped protrusion parallel to the longitudinal axis of the rear leg wherein the protrusion is located proximate to the openings, and wherein on said outer surface of each of the vertical members there is a groove matched to the bar-shaped protrusion and a button-shaped protrusion matched to the openings, wherein the bar-shaped protrusion engages the groove for guiding the structure up and down the rear legs and wherein the button-shaped protrusions engage the openings to lock the structure in place;

means for securing the apparatus to a surface; and means for supporting the cradling surface.

6. An apparatus as recited in claim 5 wherein a channel-shaped structure horizontal member is curved towards the vertical members to allow for flexibly compressing the channel along said horizontal member so that the channel can be compressed to fit between the rear legs and then allowed to expand to tightly engage openings on the rear legs and lock in place.

7. An apparatus as recited in claim 5 wherein the means for securing the apparatus to a surface comprises of a suction cup connected to a bottom of each front leg and at a bottom of the horizontal member of the channel-shaped structure proximate to each of said rear legs.

8. An apparatus for supporting an infant at a plurality of angles for facilitating feeding, bathing, sleeping and seating, fabricated from weatherable material, comprising:

an inclined cradling surface;

means for varying the incline angle of the cradling surface;

means for non-permanently securing the apparatus in place; and a crotch supporting surface extending substantially perpendicular from a lower portion of the inclined surface to support an infant's crotch to prevent sliding, wherein the crotch supporting surface can be movably adjusted along a length of a lower portion of the inclined surface for different height infants.

adjustable rear legs having a length with openings at various levels along said length;

a channel-shaped structure engaging the rear legs, said channel-shaped structure having a horizontal member between two vertical members wherein each of the vertical members comprises a protrusion to engage any of the openings on said rear leg, and wherein the channel slides along an inner surface of the rear legs, adjusting the legs' length, and locking said legs into position when the protrusions engage the openings.

* * * * *